US010414158B2

(12) United States Patent
Ojima et al.

(10) Patent No.: US 10,414,158 B2
(45) Date of Patent: Sep. 17, 2019

(54) PRINTING APPARATUS FOR FORMING STRIP-SHAPED IMAGE TO SUPPRESS INK CLOGGING AND CAN BODY PRINTED THEREBY

(71) Applicant: SHOWA ALUMINUM CAN CORPORATION, Tokyo (JP)

(72) Inventors: Shinichi Ojima, Tokyo (JP); Tetsuo Kashiwazaki, Tokyo (JP); Kazunori Ikeda, Tokyo (JP); Asumi Suwa, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 15/558,368

(22) PCT Filed: Mar. 18, 2016

(86) PCT No.: PCT/JP2016/058729
§ 371 (c)(1),
(2) Date: Sep. 14, 2017

(87) PCT Pub. No.: WO2016/163221
PCT Pub. Date: Oct. 13, 2016

(65) Prior Publication Data

US 2018/0079206 A1 Mar. 22, 2018

(30) Foreign Application Priority Data

Apr. 10, 2015 (JP) ..... 2015-081095

(51) Int. Cl.
*B41J 2/045* (2006.01)
*B05C 5/00* (2006.01)
(Continued)

(52) U.S. Cl.
CPC ..... *B41J 2/04573* (2013.01); *B05C 5/00* (2013.01); *B41J 2/01* (2013.01); *B41J 2/04586* (2013.01);
(Continued)

(58) Field of Classification Search
CPC .. B41J 2/04573; B41J 3/4073; B41J 2/04586; B41J 3/413; B41J 2/165; B41J 2/01; B65D 25/34; B05C 5/00
See application file for complete search history.

(56) References Cited

U.S. PATENT DOCUMENTS 6,896,351 B1 5/2005 Satake
2006/0055715 A1 3/2006 Nakahara et al.
(Continued)

FOREIGN PATENT DOCUMENTS

CN 1477595 A 2/2004
JP H05-097160 A 4/1993
(Continued)

OTHER PUBLICATIONS

International Search Report of PCT/JP2016/058729 dated Jun. 7, 2016.
(Continued)

*Primary Examiner* — Bradley W Thies
(74) *Attorney, Agent, or Firm* — Sughrue Mion, PLLC

(57) ABSTRACT

In ejecting ink from unused ink ejection ports or ink ejection ports not used frequently onto a can body to suppress ink clogging, the ink clogging is suppressed while degradation in the quality of an image to be formed on the can body is suppressed. On the surface of a can main body 110, a main image MG, which is a main image, and a strip-shaped image OG, which is a sub-image, are formed. The strip-shaped image OG is formed using ink ejection ports not used at forming the main image MG or low-frequency ink ejection
(Continued)

ports not ejecting ink frequently. Thus, ink clogging hardly occurs in an ink jet head.

3 Claims, 8 Drawing Sheets

(51) Int. Cl.

| | |
|---|---|
| ***B41J 2/01*** | (2006.01) |
| ***B41J 2/165*** | (2006.01) |
| ***B41J 3/413*** | (2006.01) |
| ***B41J 3/407*** | (2006.01) |
| ***B65D 25/34*** | (2006.01) |

(52) U.S. Cl.
CPC ..... *B41J 2/165* (2013.01); *B41J 3/4073* (2013.01); *B41J 3/413* (2013.01); *B65D 25/34* (2013.01); *B41J 2002/16529* (2013.01)

(56) References Cited

U.S. PATENT DOCUMENTS

| | | | | |
|---|---|---|---|---|
| 2006/0214979 | A1* | 9/2006 | Inoue | B41J 2/16585 347/22 |
| 2008/0007585 | A1* | 1/2008 | Ueda | B41J 2/16526 347/15 |
| 2010/0031834 | A1 | 2/2010 | Morgavi et al. | |
| 2012/0139980 | A1 | 6/2012 | Ishihara | |
| 2013/0176358 | A1* | 7/2013 | Yamada | B41M 1/04 347/20 |
| 2014/0028771 | A1 | 1/2014 | Yamada et al. | |

FOREIGN PATENT DOCUMENTS

| | | | | | |
|---|---|---|---|---|---|
| JP | 06-156503 | A | | 6/1994 | |
| JP | 2004-167852 | A | | 6/2004 | |
| JP | 2006-143270 | A | | 6/2006 | |
| JP | 2006-272571 | A | | 10/2006 | |
| JP | 2012-101516 | A | | 5/2012 | |
| JP | 2012-179874 | A | | 9/2012 | |
| JP | 2014-050786 | A | | 3/2014 | |
| JP | 5575958 | B2 | | 8/2014 | |
| JP | 2015-039676 | A | | 3/2015 | |
| JP | 2015039676 | A | * | 3/2015 | B41J 3/4073 |
| WO | 2014/155781 | A1 | | 10/2014 | |

OTHER PUBLICATIONS

Extended European Search Report for counterpart Application No. 16776390.3 dated Oct. 19, 2018; 13 pages.

A page of the Office Action for counterpart Chinese Patent Application No. 201680017198.1 dated Aug. 29, 2018.

* cited by examiner

PRINTING APPARATUS FOR FORMING STRIP-SHAPED IMAGE TO SUPPRESS INK CLOGGING AND CAN BODY PRINTED THEREBY

CROSS REFERENCE TO RELATED APPLICATIONS

This application is a National Stage of International Application No. PCT/JP2016/058729filed Mar. 18, 2016, claiming priority based on Japanese Patent Application No. 2015-081095filed Apr. 10, 2015, the contents of all of which are incorporated herein by reference in their entirety.

TECHNICAL FIELD

The present invention relates to a printing apparatus and a can body.

BACKGROUND ART

In Patent Document 1, there is disclosed a printer including: a mandrel wheel; multiple automatically-rotatable mandrels provided in the mandrel wheel; and an inkjet printing station for forming a print image onto an outer surface of a cylindrical container installed in the mandrel.

CITATION LIST

Patent Literature

Patent Document 1: Japanese Patent Application Laid-Open Publication No. 2014-50786

SUMMARY OF INVENTION

Technical Problem

When printing by use of an ink jet head is performed onto a can body, if there is any unused ink ejection port or an ink ejection port not used frequently, ink clogging is likely to occur in the ink ejection port.

Occurrence of the ink clogging can be suppressed by, for example, ejecting ink from the ink ejection port onto a can body; however, if the ink is ejected onto the can body, degradation in the quality of image to be formed is likely to be caused.

An object of the present invention is, in ejecting ink from unused ink ejection ports or ink ejection ports not used frequently onto a can body to suppress ink clogging, to suppress the ink clogging while suppressing degradation in the quality of an image to be formed on the can body.

Solution to Problem

A printing apparatus to which the present invention is applied includes: an ink jet head that includes multiple ink ejection ports and ejects ink to an outer circumferential surface of a can body to perform image formation on the outer circumferential surface; and a head control unit that controls the ink jet head to form an image on the outer circumferential surface and ejects ink from at least one of an unused ink ejection port that is not used in forming the image and a low-frequency ink ejection port with a frequency of ink ejection lower than a predetermined frequency of ink ejection, the head control unit further causing, in ejecting the ink from at least one of the unused ink ejection port and the low-frequency ink ejection port, the ink to attach to a strip-shaped region of the outer circumferential surface that extends along an axial direction of the can body.

Here, the multiple ink jet heads are provided and the respective ink jet heads eject inks of different colors from one another, and the head control unit controls the respective ink jet heads to produce a same color in respective pixels composing an image formed by attaching the ink to the strip-shaped region. In this case, it is possible to make the image formed in the strip-shaped region less conspicuous, as compared to a case in which colors of the respective pixels composing the image formed by attaching the ink to the strip-shaped region are different.

Moreover, the head control unit attaches the ink to the strip-shaped region to form a character image that indicates a character within the strip-shaped region. In this case, it becomes possible to include character information in the image formed by attaching the ink to the strip-shaped region.

Moreover, when the present invention is recognized as a can body, the can body to which the present invention is applied includes: a can main body that is formed cylindrically and includes an outer circumferential surface; and an image formed on the outer circumferential surface of the can main body by an ink jet head, wherein the image formed on the outer circumferential surface of the can main body includes a strip-shaped image that extends along an axial direction of the can main body and is formed in a strip shape.

Here, the strip-shaped image is formed from one end portion to the other end portion in the axial direction of the can main body and in an entire region from the one end portion to the other end portion. In this case, it becomes possible to eject ink from more unused ink ejection ports or low-frequency ink ejection ports, as compared to a case in which the strip-shaped image is not formed in the entire region from the one end portion to the other end portion and the strip-shaped image includes blanks.

Moreover, the multiple strip-shaped images are formed in rows and provided in positions shifted from one another in a circumferential direction and the axial direction of the can main body, and the multiple strip-shaped images are formed to generate an overlap between two strip-shaped images when the two strip-shaped images of the multiple strip-shaped images, which are adjacent to each other in the axial direction, are projected in the circumferential direction of the can main body. In this case, it becomes possible to eject ink from more unused ink ejection ports or low-frequency ink ejection ports, as compared to a case in which the overlap is not generated between the strip-shaped images.

Moreover, the strip-shaped image is composed of an image including character images, each of which is an image indicating a character, arranged in line in the axial direction. In this case, it becomes possible to allow the strip-shaped image to have meaning.

Moreover, the character images arranged in line in the axial direction are provided in multiple rows, and each of the character images is arranged to allow, between character images that are positioned in a row and are adjacent to each other in the axial direction, a character image in another row to be positioned. In this case, it becomes possible to eject ink from more unused ink ejection ports or low-frequency ink ejection ports, as compared to a case in which, between character images that are positioned in a row and are adjacent to each other, a character image in another row is not positioned.

Advantageous Effects of Invention

According to the present invention, in ejecting ink from unused ink ejection ports or ink ejection ports not used frequently onto a can body to suppress ink clogging, it is possible to suppress the ink clogging while suppressing degradation in the quality of an image to be formed on the can body.

DESCRIPTION OF EMBODIMENTS

Hereinafter, an exemplary embodiment according to the present invention will be described in detail with reference to attached drawings.

Figure 1A:
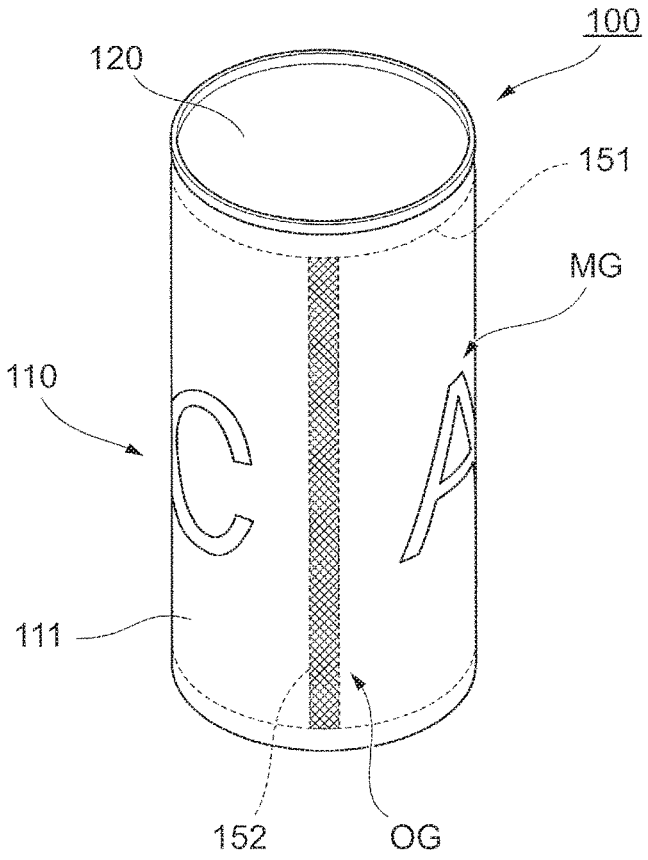
FIGS. 1A and 1B are diagrams showing a can body of an exemplary embodiment.
Figure 1B:
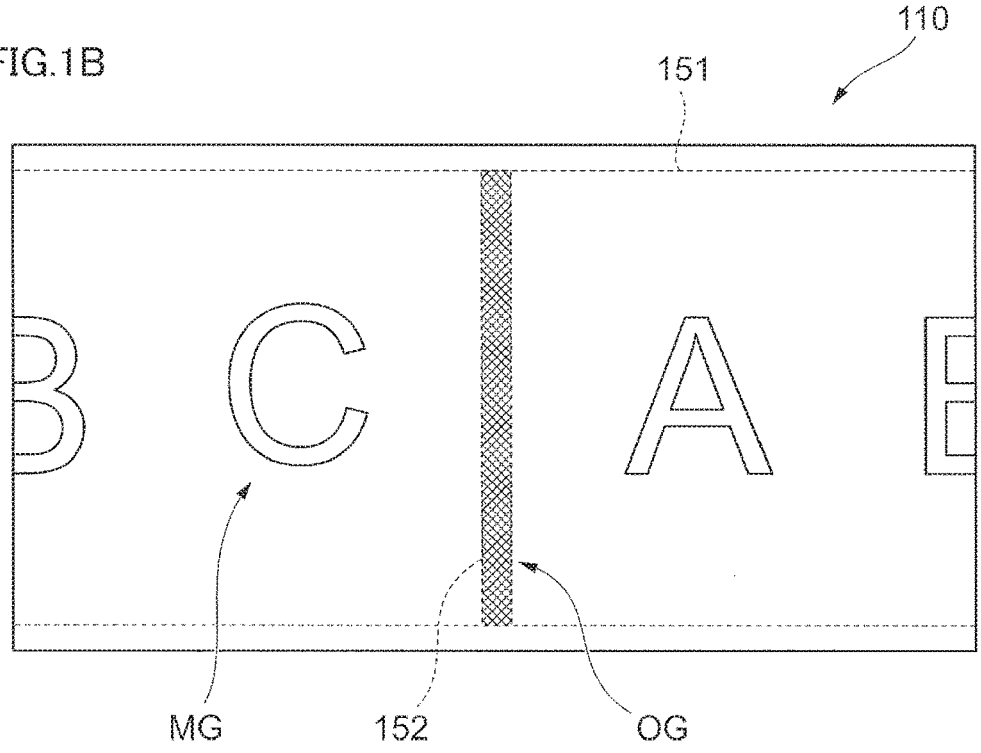

FIGS. 1A and 1B are diagrams showing a can body 100 of the exemplary embodiment. Note that FIG. 1A is a diagram viewing the can body 100 from diagonally above, and FIG. 1B is a development diagram of a can main body 110 (a barrel portion of the can body 100).

As shown in FIG. 1A, the can body 100 is provided with the can main body 110 in a cylindrical shape.

The can main body 110 has an outer circumferential surface 111. Further, the can body 100 is provided with a lid member 120 that closes an opening positioned at one end portion of the can main body 110. Further, a bottom portion (not shown) is provided to an opposite side of the lid member 120.

As shown in FIGS. 1A and 1B, on the outer circumferential surface 111 of the can main body 110, a main image MG, which is a main image, and a strip-shaped image OG, which is a sub-image, are formed.

Here, the main image MG is, for example, an image serving as a "face" of a product and an image representing imagery or the like of a product. The main image MG is formed on a main image formation region 151 extending along the circumferential direction of the can main body 110.

The strip-shaped image OG is an image extending along the axial direction of the can main body 110 and formed in a strip shape.

The strip-shaped image OG is, as shown in FIG. 1A, formed from one end portion to the other end portion in the axial direction of the can main body 110 over an entire region extending from the one end portion to the other end portion. Here, the strip-shaped image OG is composed of, for example, patterned designs, characters, symbols or others. Moreover, the strip-shaped image OG is formed in a strip-shaped image formation region 152 formed in a rectangular shape.

Further, in the exemplary embodiment, each of the main image MG and the strip-shaped image OG is formed by the so-called ink jet method. In the exemplary embodiment, the main image MG and the strip-shaped image OG are formed by ejecting ink from ink jet heads (ink jet print heads) toward the outer circumferential surface 111 of the can main body 110.

To describe further and specifically, in the exemplary embodiment, multiple ink jet heads are prepared and different colors of ink are ejected from the respective ink jet heads toward the outer circumferential surface 111 of the can body 100. An ink ejection surface of the ink jet head is provided with multiple ink ejection ports, and ink is ejected from the ink ejection port corresponding to the image to be formed.

Each ink jet head is provided with multiple rooms (hereinafter, referred to as "ink chambers") provided to ejection drive units, such as piezoelectric elements, and the ink ejection port is provided to each ink chamber.

The ink supplied to each of the ink jet heads is supplied to the ink chamber via a manifold.

By the way, to form the image on the can body 100, the ink is ejected from the ink ejection port corresponding to the image to be printed. In this case, there exist some ink ejection ports that do not eject the ink. Moreover, there exist some ink ejection ports that eject ink but do not eject frequently (ink ejection ports ejecting ink infrequently).

In this case, in the ink ejection port and the ink chamber, there is a possibility of ink drying to cause changes in ink viscosity.

If the ink viscosity is changed in this manner, later, an intended amount of ink is not ejected in forming images by use of the ink ejection port, to be likely to lead to degradation of image quality.

To describe further, in the printing method using the ink jet head, there exist ink ejection ports that do not perform ink ejection (hereinafter, referred to as "unused ink ejection ports") or ink ejection ports that eject ink infrequently (hereinafter, referred to as "low-frequency ink ejection ports"); in these ink ejection ports, there is a possibility of causing precipitation of compositions of ink, increase in ink viscosity, curing of ink or the like, and accordingly, the ink is less likely to be ejected.

To describe more specifically, in the ink jet head, the ink filled into the ink jet head is supplied to the ink chamber provided to the ejection drive unit, such as the piezoelectric element, as described above, and the ink chamber is filled with the ink. In this case, if a state of not ejecting ink or a state of ejecting ink infrequently is continued in some ink chamber, there is a possibility that the ink is cured in the ink ejection port or in the ink chamber, and accordingly, an intended amount of ink is cannot be ejected.

Moreover, in forming color images, the unused ink ejection ports or the low-frequency ink ejection ports are also generated.

In general, ink used in color printing includes four colors of magenta, yellow, cyan and black. Moreover, white is used in response to the background color in some cases. Then, in forming the image, the color image is formed by overlapping the respective colors of ink.

In such an image forming mode, depending on an image to be formed, it is assumed that only a part of colors of ink is used; accordingly, in the ink jet print heads ejecting other colors of ink, the ink is likely to be cured.

To suppress occurrence of the above-described inconvenience, in the exemplary embodiment, the above-described strip-shaped image OG is formed by use of the unused ink ejection ports or the low-frequency ink ejection ports.

To additionally describe, in the exemplary embodiment, the ink is ejected from the unused ink ejection ports or the low-frequency ink ejection ports, and when the ejection is performed, the ink is made to be attached to the strip-shaped image formation region 152. Thus, ink clogging hardly occurs in the ink jet heads.

Here, since the strip-shaped image OG is not a main image, it is preferable that the strip-shaped image OG is less conspicuous.

As in the exemplary embodiment, when the strip-shaped image OG is provided along the axial direction of the can main body 110, the strip-shaped image OG becomes less conspicuous; therefore, a user tends to be less aware of the strip-shaped image OG. Consequently, in the exemplary embodiment, even though the strip-shaped image OG exists, damage to sense of beauty in the entire can body 100 is suppressed.

Figure 2:
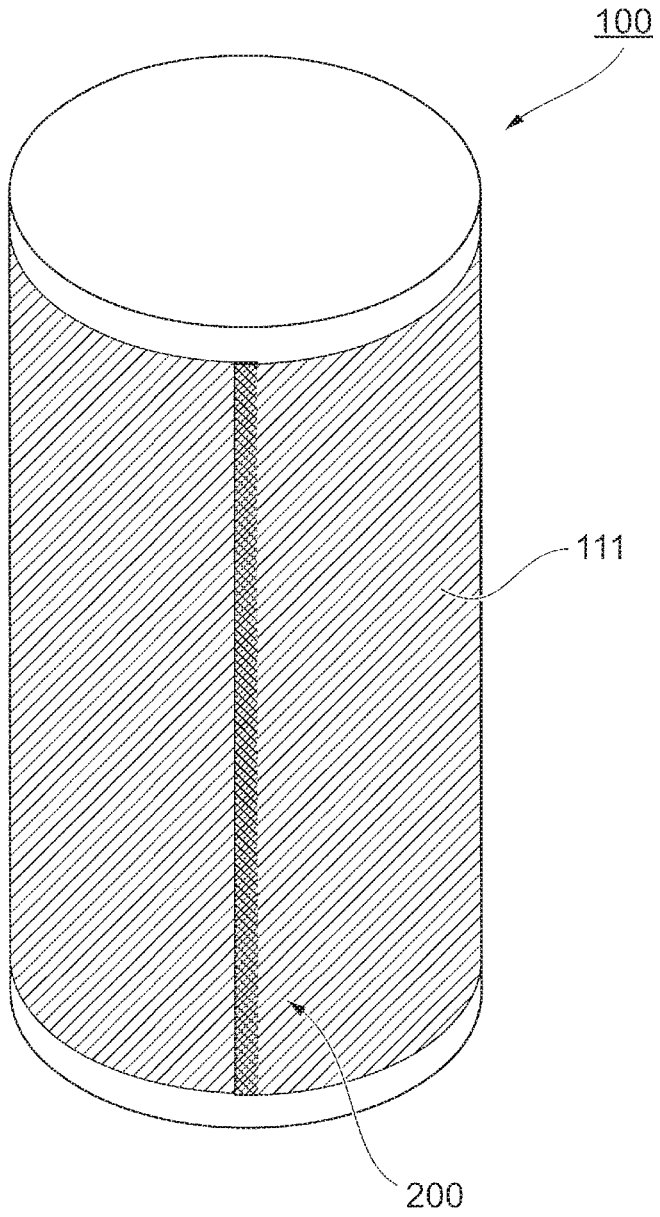
FIG. 2 is a diagram showing a can body subjected to printing by use of plate printing.

FIG. 2 is a diagram showing the can body 100 subjected to printing by use of plate printing. To additionally describe, FIG. 2 is a diagram showing the can body 100 subjected to printing by use of a printing method now widely performed.

In the plate printing, ink is transferred from a plate originating a print image to a blanket, and while the blanket to which the ink has been transferred is pressed against the outer circumferential surface 111 of the can body 100, the can body 100 or the blanket is rotated to perform printing onto the outer circumferential surface 111 of the can body 100.

In the plate printing to the can body 100, normally, to prevent a blank from being generated in an image, one end and the other end in the circumferential direction of the image to be formed are overlapped. To additionally describe, in the plate printing to the can body 100, printing to the can body 100 is performed such that the strip-shaped image wraps around the can body 100; on this occasion, one end and the other and of the strip-shaped image are overlapped.

In this case, as shown in FIG. 2, in the image formed on the outer circumferential surface 111, a strip-shaped image 200 is formed.

Most of the can bodies 100 now being widely distributed are subjected to printing by the plate printing, and thereby the strip-shaped image 200 is formed on the can bodies 100 now being distributed. Then, since a user has many chances to see the strip-shaped image 200, the user gets used to the strip-shaped image 200. As a result, the strip-shaped image 200 becomes less conspicuous to the user.

In the exemplary embodiment, the characteristics of the strip-shaped image 200 are used.

If the ink is simply ejected from the unused ink ejection ports or the low-frequency ink ejection ports toward the main image MG on the outer circumferential surface 111, the image quality of the main image MG is degraded.

To describe in detail, when the main image MG is formed on the outer circumferential surface 111, the main image MG is composed as an aggregate of dot-shaped inks on the outer circumferential surface 111. At this time, the types and arrangements of all individual dot-shaped inks, which serve as constructs, are determined in advance, and accordingly, the main image MG is formed on the outer circumferential surface 111 by arranging inks of the predetermined types at the predetermined positions on the outer circumferential surface 111 as dots. Therefore, arrangements of inks other than the predetermined types at the predetermined positions, such as simply ejecting ink from the unused ink ejection ports or the low-frequency ink ejection ports, result in damaging originally-intended quality of the main image MG, and accordingly, the image quality of the main image MG is degraded.

In contrast thereto, in the exemplary embodiment, the ink is ejected to the strip-shaped image formation region 152 without being ejected to the main image MG.

In this case, degradation in image quality of the main image MG is suppressed. Further, the strip-shaped image OG formed on the strip-shaped image formation region 152 resembles the strip-shaped image 200 formed in the above-described plate printing, and thereby the strip-shaped image OG is hardly recognized by a user and becomes less conspicuous.

As another example, a mode can be considered in which waste cans (can bodies 100 not to be shipped as the products) are prepared and put into the printing apparatus, to thereby eject ink to the waste cans from the unused ink ejection ports or the low-frequency ink ejection ports.

In this case, efforts are required to reclaim the waste cans. Moreover, the can bodies 100 to be discarded are generated, and accordingly, material losses occur.

Here, the strip-shaped image OG may be formed on all of the can bodies 100, or the strip-shaped image OG may be formed every time the printing is performed on a predetermined number of can bodies 100.

Moreover, the length and the width of the strip-shaped image OG are not particularly limited. In the example shown in FIG. 1, the length of the strip-shaped image OG (the length in the axial direction of the can main body 110) is assumed to be the same as the length of the main image formation region 151. Further, in the exemplary embodiment, the length of the strip-shaped image OG (the length in the axial direction of the can main body 110) is assumed to be the same length as the maximum length of the image printable on the can body 100 (the maximum length in the axial direction of the can main body 110).

Moreover, to form the strip-shaped image OG, it is unnecessary to form the same strip-shaped image OG on all of the can bodies 100, and the strip-shaped image OG may be different in each can body 100.

The printing by use of ink jet heads is usually digital printing; a process of differentiating the image in each can body 100 can be performed with ease in the digital printing.

Further, it may be possible to differentiate the strip-shaped image OG in each can body 100, and further, to assign a story to each of the strip-shaped images OG. In this case, by preparing multiple can bodies 100, the entire story can be understood.

Note that, in this case, the main image MG may serve as an image to complement the story, or may serve as an image to constitute a key for uncovering the story.

Figure 3B:
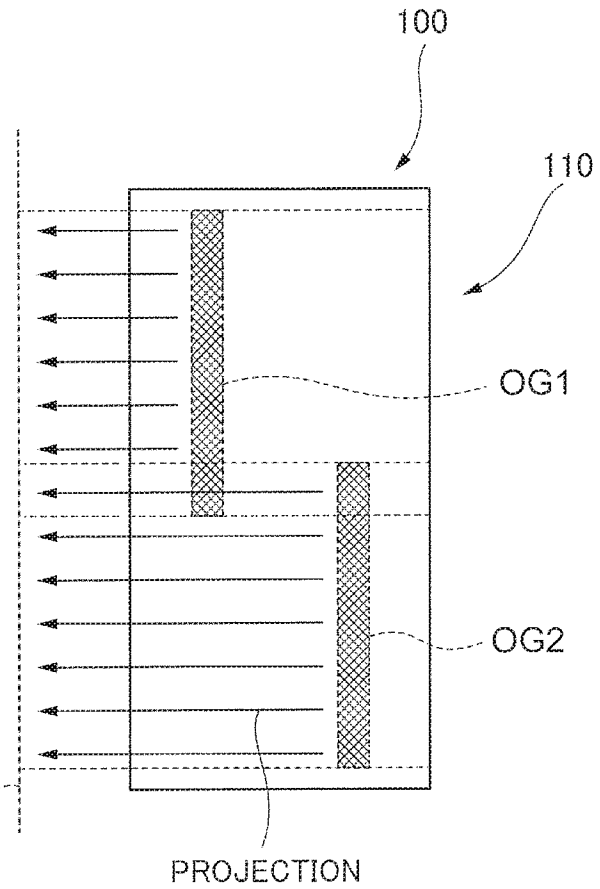
FIGS. 3A and 3B are diagrams showing another configuration example of the can body.
Figure 3A:
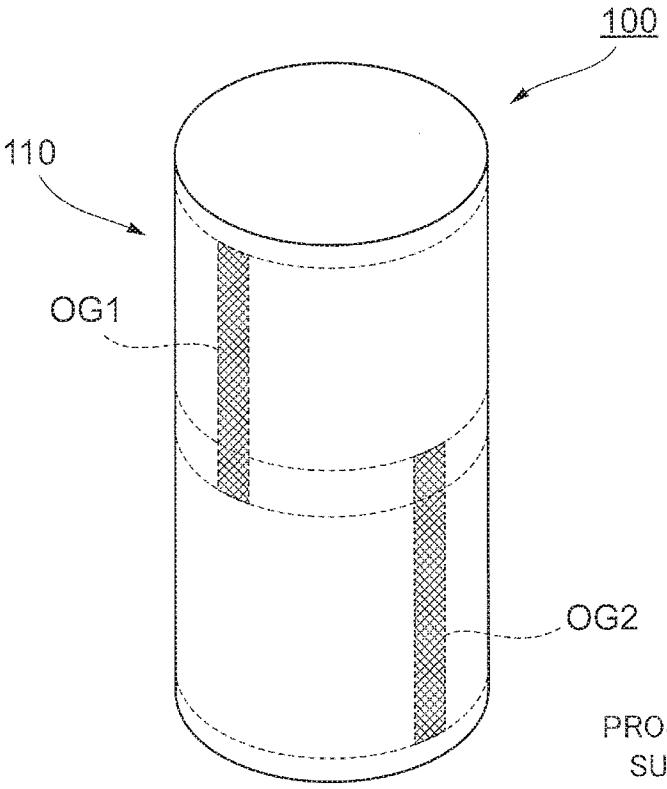

FIGS. 3A and 3B are diagrams showing another configuration example of the can body 100. Note that FIG. 3A is a diagram viewing the can body 100 from diagonally above, and FIG. 3B is a front elevational view.

In this configuration example, the strip-shaped image OG is divided, and the strip-shaped images OG are formed at two locations. Consequently, two strip-shaped images OG, namely, a first strip-shaped image OG1 and a second strip-shaped image OG2 are formed.

Further, in this configuration example, the first strip-shaped image OG1 and the second strip-shaped image OG2 are formed at positions in the circumferential direction and in the axial direction of the can main body 110 that are different from each other.

To additionally describe, in this configuration example, placement positions of the first strip-shaped image OG1 and the second strip-shaped image OG2 are deviated from each other in the circumferential direction and in the axial direction of the can main body 110.

Further, in the exemplary embodiment, the first strip-shaped image OG1 and the second strip-shaped image OG2 overlap in the axial direction of the can main body 110.

To describe further, in this configuration example, the first strip-shaped image OG1 and the second strip-shaped image OG2 are adjacent to each other in the axial direction of the can main body 110.

Moreover, when the first strip-shaped image OG1 and the second strip-shaped image OG2 are projected in the circumferential direction of the can main body 110 as shown in FIG. 3B (when projection is performed onto a virtual projection surface extending along the axial direction of the can main body 110), an overlap is generated between the first strip-shaped image OG1 and the second strip-shaped image OG2.

Here, when the overlap is not provided between the first strip-shaped image OG1 and the second strip-shaped image OG2 and a blank is generated therebetween, the ink cannot be ejected from the ink ejection port corresponding to the blank. In this case, if the unused ink ejection port or the low-frequency ink ejection port is positioned at a location corresponding to the blank, ink cannot be ejected from the unused ink ejection port or the low-frequency ink ejection port, and therefore, ink clogging is likely to occur in these ink ejection ports.

On the other hand, when two strip-shaped images overlap as in the exemplary embodiment, occurrence of such an inconvenience can be suppressed.

Figure 4:
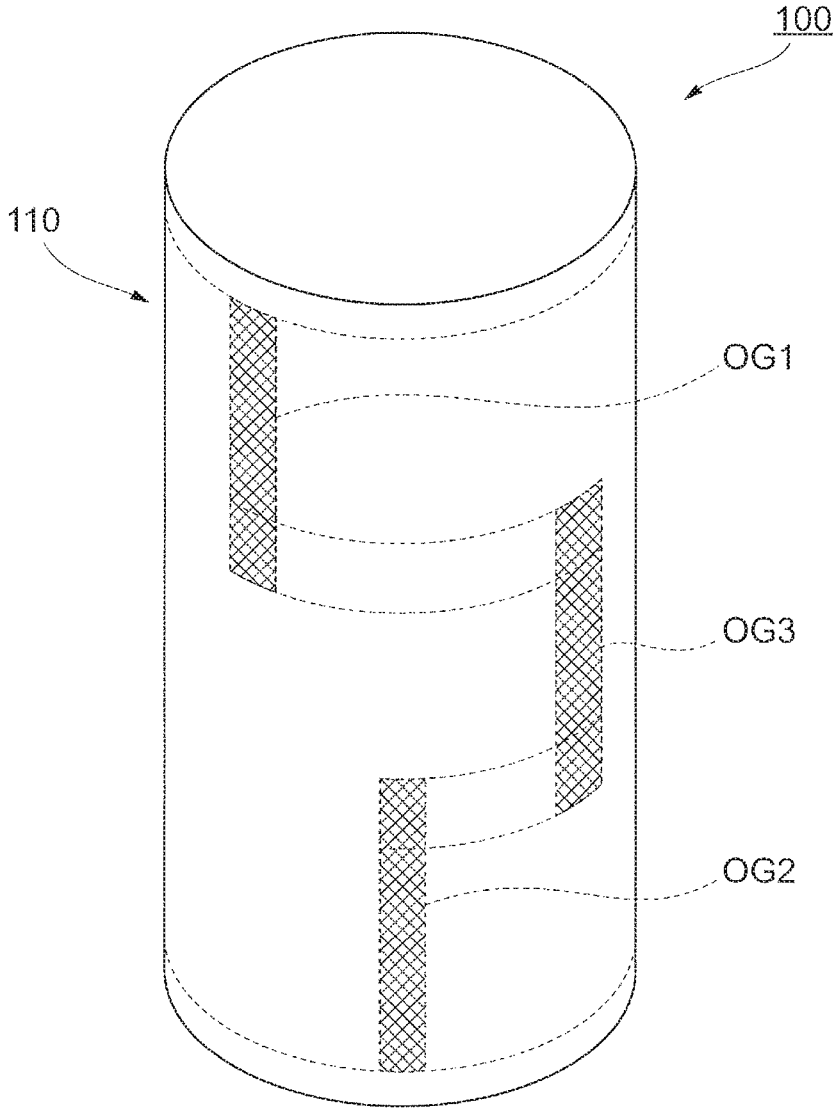
FIG. 4 is a diagram showing another arrangement example of strip-shaped images.

Note that, in FIG. 3, description has been given by taking a case in which two strip-shaped images are provided as an example; however, the number of strip-shaped images is not particularly limited and, for example, three strip-shaped images may be formed as shown in FIG. 4 (a diagram showing another arrangement example of the strip-shaped images).

Here, in FIG. 4, the first strip-shaped image OG1 and a third strip-shaped image OG3 become the two strip-shaped images adjacent to each other in the axial direction, and an overlap is generated between the first strip-shaped image OG1 and the third strip-shaped image OG3 that are adjacent to each other in the axial direction.

Moreover, the second strip-shaped image OG2 and the third strip-shaped image OG3 become the two strip-shaped images adjacent to each other in the axial direction, and an overlap is generated between the second strip-shaped image OG2 and the third strip-shaped image OG3.

FIGS. 5A to 5E are diagrams illustrating details of the strip-shaped image OG.

Figures 5A, 5B, 5C, 5D, 5E:
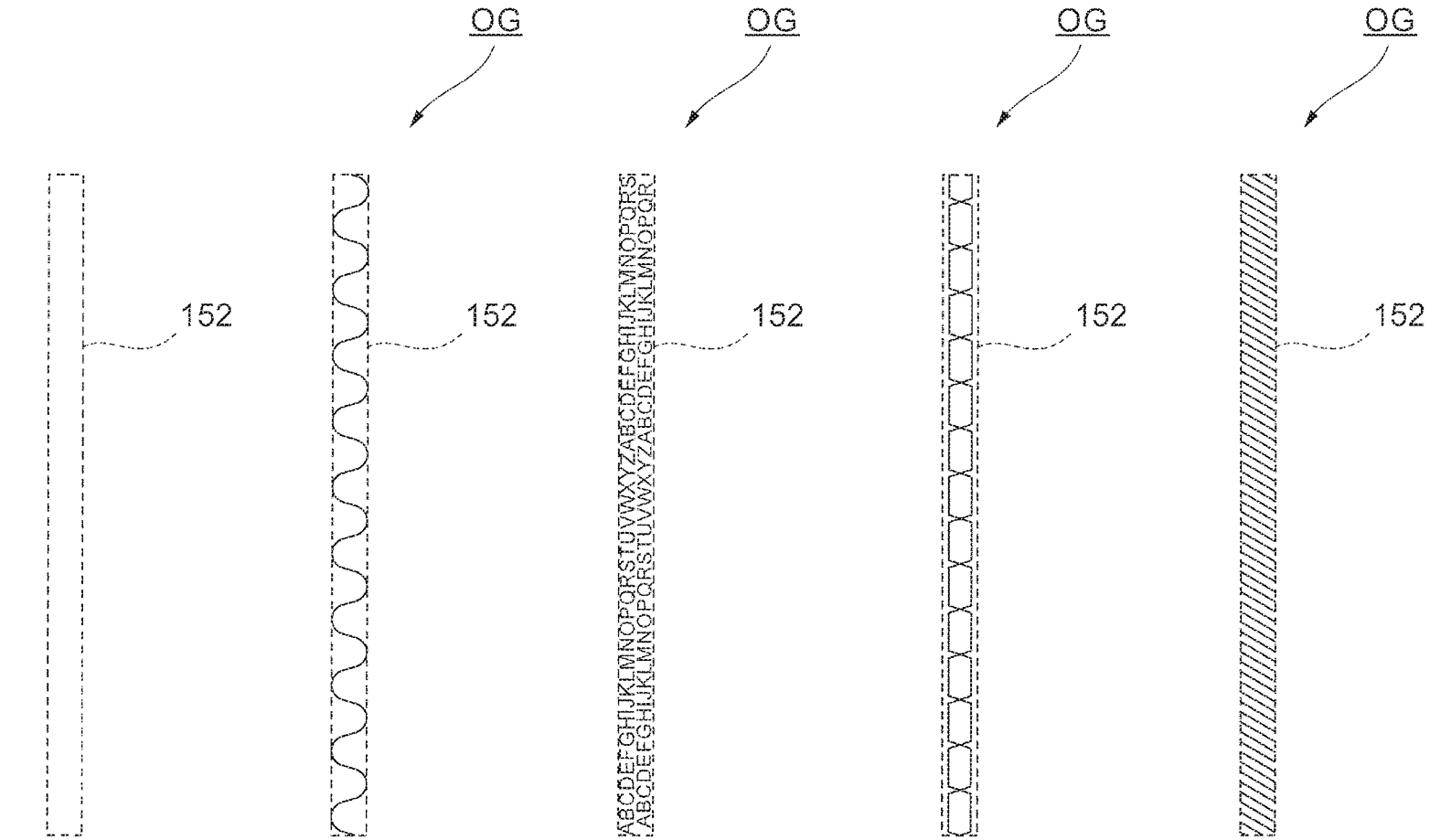
FIGS. 5A to 5E are diagrams illustrating details of the strip-shaped image.

FIG. 5A shows the strip-shaped image formation region 152 on the outer circumferential surface 111 of the can main body 110. The strip-shaped image formation region 152 is formed in a rectangular shape.

Note that the strip-shaped image formation region 152 is not limited to the rectangular shape as shown in FIG. 5A; the strip-shaped image formation region 152 may be in an oval shape, an elliptical shape, or a polygonal shape, such as a trapezoidal shape or a parallelogram shape.

The ink is ejected into the inside of the strip-shaped image formation region 152, and thereby the strip-shaped image OG is formed.

FIG. 5B shows an example of the strip-shaped image OG and exemplifies a case in which the strip-shaped image OG includes an image of a curved line.

FIG. 5C exemplifies a case in which the strip-shaped image OG is composed of character images, which are images indicating characters. Specifically, a case in which the strip-shaped image OG is composed of multiple images each including multiple character images arranged in line in the axial direction of the can main body 110 is exemplified. Note that the character image is a concept including numeric characters.

FIG. 5D exemplifies a case in which the strip-shaped image OG is composed of an image including multiple unit images being arranged (patterned design).

FIG. 5E exemplifies a case in which the strip-shaped image OG is composed of diagonal lines.

Figure 6:
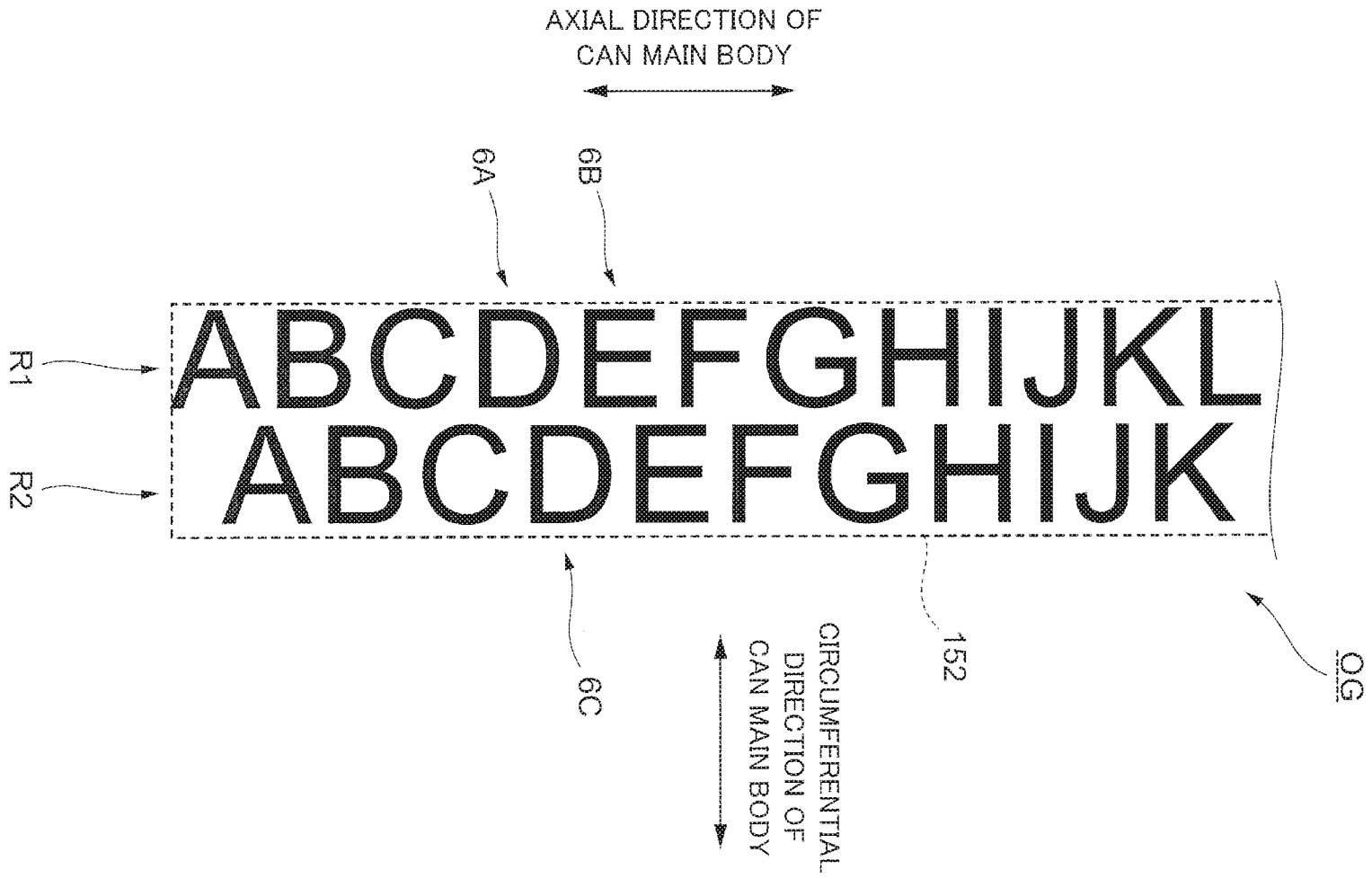
FIG. 6 is a diagram in which a part of the strip-shaped image shown in FIG. 5C is enlarged.

FIG. 6 is a diagram in which a part of the strip-shaped image OG shown in FIG. 5C is enlarged.

As described above, the strip-shaped image OG is composed of multiple images each including multiple character images arranged in line in the axial direction of the can main body 110. Further, in this configuration example, alphabetical characters are arranged.

Here, when the strip-shaped image OG is formed to include the character image, it becomes possible to allow the strip-shaped image OG to have meaning. This makes it possible to allow the strip-shaped image OG to include, for example, a product name, a trade name or others.

Further, in the configuration example shown in FIG. 6, character images arranged in the axial direction are in multiple rows (in the exemplary embodiment, provided in two rows).

Further, each of the character images is arranged such that, between the character images that are positioned in a first row (one row) R1 and are adjacent to each other in the axial direction, a character image in a second row (the other row) R2 is positioned. To describe more specifically, between the two character images indicated by the signs 6A and 6B, the character image indicated by the sign 6C is positioned.

To put it another way, in this configuration example, the character images are displayed in two rows, and the character images positioned in the second row are shifted by half a character with respect to the character images positioned in the first row.

To describe further, in this configuration example, a character image positioned in one of the character image rows adjacent to each other is shifted by half a character with respect to a character image positioned in the other character image row.

Consequently, in this configuration example, the blanks become less likely to be generated in the strip-shaped image OG, and similar to the above, it is possible to prevent the unused ink ejection ports or the low-frequency ink ejection ports from being positioned at the locations corresponding to the blanks.

Figure 7:
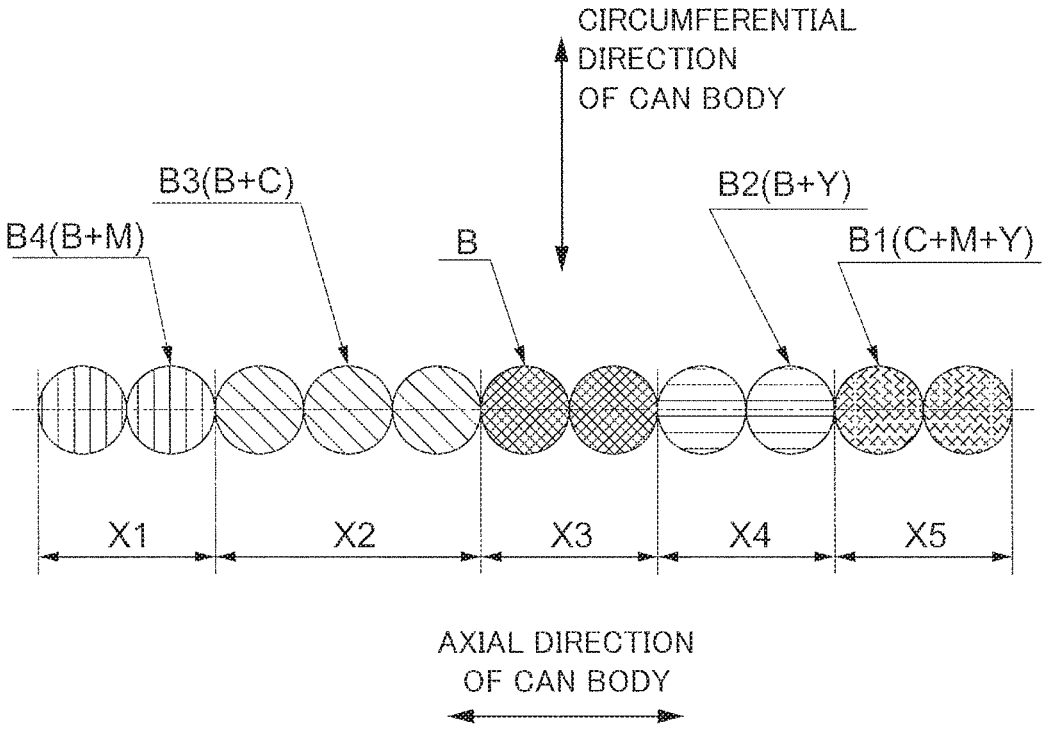
FIG. 7 is a diagram illustrating each pixel constituting the strip-shaped image.

FIG. 7 is a diagram illustrating each pixel constituting the strip-shaped image OG.

In FIG. 7, "B" indicates a pixel (dot) formed with black ink (B). "B1" indicates a pixel in black formed by overlapping the three colors of ink of cyan (C), magenta (M) and yellow (Y).

"B2" indicates a pixel in black formed by overlapping the two colors of ink of black (B) and yellow (Y).

"B3" indicates a pixel in black formed by overlapping the two colors of ink of black (B) and cyan (C).

"B4" indicates a pixel in black formed by overlapping the two colors of ink of black (B) and magenta (M).

In this example, the ranges X1, X2, X3, X4 and X5 are shown as a printing range and, in the ranges X1 to X5, pixels of B and B1 to B4 are connected to form a straight line.

Moreover, though illustration is omitted, the straight lines are arranged in multiple rows in the circumferential direction of the can main body 110. Consequently, the strip-shaped image OG is formed.

To put is another way, in this configuration example, the unused ink ejection ports or the low-frequency ink ejection ports eject the ink, not only one time, but multiple times, to thereby arrange the pixels in the circumferential direction of the can main body 110 to form the strip-shaped image OG.

Here, in this configuration example, in the range X1, the main image MG is formed with the two colors of ink of cyan (C) and yellow (Y).

Therefore, in the range X1, in forming the strip-shaped image OG, inks of black (B) and magenta (M), which are not used in forming the main image MG, are used (ejected).

Moreover, in the range X2, the main image MG is formed with the two colors of ink of magenta (M) and yellow (Y). Therefore, in the range X2, inks of black (B) and cyan (C), which are not used in forming the main image MG, are used.

Moreover, in the range X3, the main image MG is formed with the three colors of ink of cyan (C), yellow (Y) and magenta (M). Therefore, in the range X3, ink of black (B), which is not used in forming the main image MG, is ejected.

Moreover, in the range X4, the main image MG is formed with the three colors of ink of cyan (C), magenta (M) and black (B). In the range X4, in forming the strip-shaped image OG, inks of black (B) and yellow (Y) are used.

Here, in the range X4, the ink not used in forming the main image MG is yellow (Y) only; however, since yellow (Y) only cannot create the black color, the ink of, not only yellow (Y), but also black (B) is ejected in this configuration example. Note that it may be possible to create black by use of three colors of ink of yellow (Y), cyan (C) and magenta (M) without using black (B). However, in this case, costs of ink to be used is increased as compared to the case where only one color, black (B), is used.

In the range X5, the main image MG is formed with ink of black (B). Therefore, in the range X5, in forming the strip-shaped image OG, the inks of cyan (C), yellow (Y) and magenta (M), which are not used in forming the main image MG, are used.

Here, in the exemplary embodiment, as described above, the colors of pixels forming the strip-shaped image OG are made to be the same in forming the strip-shaped image OG.

To additionally describe, the ink is ejected from, not only the unused ink ejection ports or the low-frequency ink ejection ports, but also ink ejection ports other than the unused ink ejection ports or the low-frequency ink ejection ports (normal ink ejection ports) as needed (for unifying colors). This reduces unevenness in colors of the strip-shaped image OG, and further makes the strip-shaped image OG less conspicuous.

Note that there is a possibility that, in any of the ranges (part of ranges in the axial direction), the main image MG is formed by using four (all) colors of ink of cyan (C), yellow (Y), magenta (M) and black (B).

In this case, in the part of ranges, in forming the strip-shaped image OG, for example, pixels are formed by using black (B) only. Alternatively, the black pixels are formed by using cyan (C), yellow (Y) and magenta (M).

Moreover, as another example, in the above-described part of ranges, a mode can be considered in which the strip-shaped image OG is not formed. In this case, the strip-shaped image OG is formed not all the regions in the axial direction of the can main body 110, and blanks are generated in part of the strip-shaped image OG.

Figure 8B:
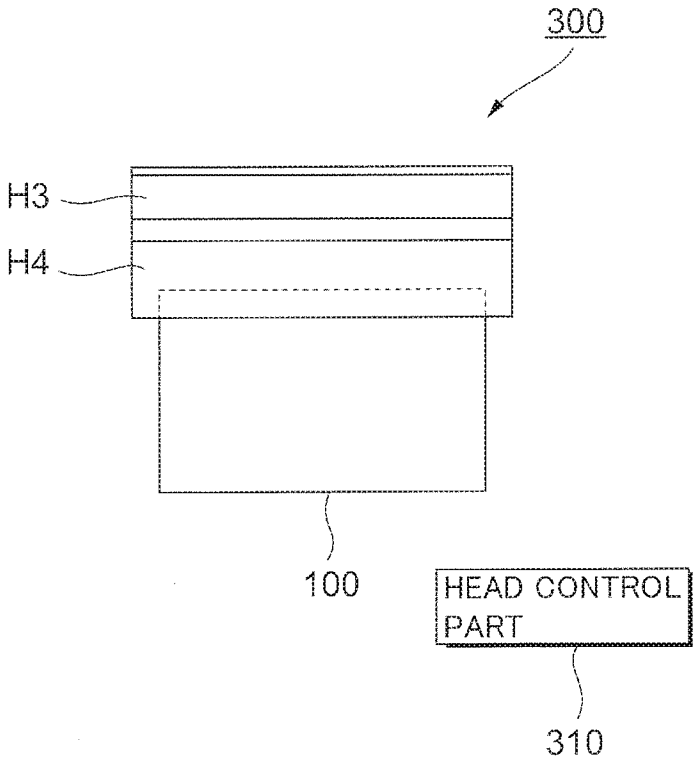
FIGS. 8A and 8B are diagram showing an example of a printing apparatus that performs above-described printing process.
Figure 8A:
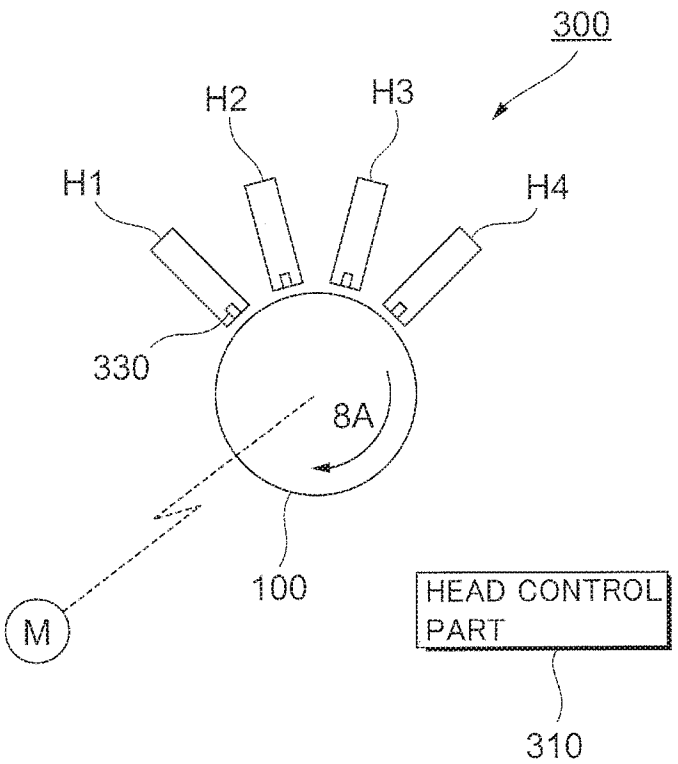

FIGS. 8A and 8B are diagram showing an example of a printing apparatus 300 that performs above-described printing process. Note that FIG. 8A is a front elevational view and FIG. 8B is a side elevational view.

The printing apparatus 300 is a so-called digital printer and performs printing onto the can body 100 based on image data.

The printing apparatus 300 is provided with a motor M that rotates the can body 100 in the direction indicated by arrow 8A. Further, four ink jet heads H1, H2, H3 and H4 arranged radially around the can body 100 are provided.

The four ink jet heads H1, H2, H3 and H4 eject inks of cyan (C), yellow (Y), magenta (M) and black (B), respectively.

Further, the printing apparatus 300 is provided with a head control part 310 that is configured to include a program-controlled CPU and controls ejection of ink from the ink jet heads H1 to H4.

As shown in FIG. 8A, each of the ink jet heads H1 to H4 is provided with an ink ejection port 330 that ejects ink to the can body. In each of the ink jet heads H1 to H4, multiple ink ejection ports 330 are provided and are arranged along the axial direction of the can body 100.

Note that, in FIG. 8A, a case in which the ink ejection ports 330 are provided in a row in each of the ink jet heads H1 to H4 is exemplified; however, in each of the ink jet heads H1 to H4, the ink ejection ports 330 may be provided in multiple rows.

In the exemplary embodiment, the four ink jet heads H1 to H4 are controlled by the head control part 310, and thereby the ink is ejected to the can body 100. Consequently, the above-described main image MG is formed.

Further, the head control part 310 recognizes the unused ink ejection ports that are not used in forming the main image MG, and controls the ink jet heads H1 to H4 to cause the ink from the unused ink ejection ports to attach to the strip-shaped image formation region 152.

More specifically, at the timing of when the strip-shaped image formation region 152 arrives at the location where the unused ink ejection port faces, the ink is made to be ejected from the unused ink ejection port.

In this case, the can body to be an object of ink ejection from the unused ink ejection ports may be all of the can bodies 100, or it is possible to perform ejection every predetermined number of can bodies 100.

Moreover, the head control part 310 recognizes the low-frequency ink ejection ports with a frequency of ink ejection lower than a predetermined frequency of ink ejection, and controls the ink jet heads H1 to H4 to cause the ink from the low-frequency ink ejection ports to attach to the strip-shaped image formation region 152.

More specifically, at the timing of when the strip-shaped image formation region 152 arrives at the location where the low-frequency ink ejection port faces, the ink is made to be ejected from the low-frequency ink ejection port.

In this case, as compared to the unused ink ejection ports, it is possible to perform a process of reducing the number of times of ink ejection or the like.

By the above-described process, ink clogging at the unused ink ejection ports or the low-frequency ink ejection ports can be suppressed. Further, ink clogging in the ink chamber where the unused ink ejection ports or the low-frequency ink ejection ports are provided can be suppressed.

REFERENCE SIGNS LIST

100 Can body
110 Can main body

111 Outer circumferential surface
152 Strip-shaped image formation region
300 Printing apparatus
310 Head control part
330 Ink ejection port
H1, H2, H3, H4 Ink jet head
OG Strip-shaped image

The invention claimed is:

1. A printing apparatus comprising:

an ink jet head that includes a plurality of ink ejection ports and ejects ink to an outer circumferential surface of a can body to perform image formation on the outer circumferential surface; and a head control unit that controls the ink jet head to form an image on the outer circumferential surface and ejects ink from at least one of an unused ink ejection port that is not used in forming the image and an low-frequency ink ejection port with a frequency of ink ejection lower than a predetermined frequency of ink ejection, the head control unit further causing, in ejecting the ink from at least one of the unused ink ejection port and the low-frequency ink ejection port, the ink to attach to a strip-shaped region of the outer circumferential surface that extends along an axial direction of the can body, the strip-shaped region being from one end portion to the other end portion in the axial direction of the can body, wherein a plurality of the ink jet heads are provided and the respective ink jet heads eject inks of different colors from one another, the head control unit controls the respective ink jet heads to produce a same color in respective pixels composing an image formed by attaching the ink to the strip-shaped region, and in a case where a color of the pixels produced by inks from at least one of the unused ink ejection port and the low-frequency ink ejection port included in one of the plurality of the ink jet heads does not exhibit a specific color, the head control unit causes another one of the plurality of the ink jet heads to eject an ink of another color to make the color of the pixels exhibit the specific color, and in a case where a color of the pixels produced by inks from at least one of the unused ink ejection port and the low-frequency ink ejection port exhibits the specific color, the head control unit causes another one of the plurality of the ink jet heads not to eject an ink of another color, such that each pixel over an entire area of the strip-shaped region from the one end portion to the other end portion exhibits the specific color.

2. The printing apparatus according to claim 1, wherein the head control unit attaches the ink to the strip-shaped region to form a character image that indicates a character within the strip-shaped region.

3. The printing apparatus according to claim 1, wherein the head control unit attaches the ink to the strip-shaped region to form a character image that indicates a character within the strip-shaped region.

* * * * *